United States Patent [19]

Koppensteiner

[11] Patent Number: 4,598,798

[45] Date of Patent: Jul. 8, 1986

[54] SLIDING SHOE SYSTEM

[75] Inventor: Werner Koppensteiner, Vienna, Austria

[73] Assignee: Otis Elevator Company, Farmington, Conn.

[21] Appl. No.: 626,566

[22] Filed: Jun. 29, 1984

[30] Foreign Application Priority Data

Jan. 31, 1984 [AT] Austria ..... 309/84

[51] Int. Cl.[4] ..... B66B 7/02

[52] U.S. Cl. ..... 187/95; 384/33

[58] Field of Search ..... 187/95; 104/242; 182/103; 308/3 R, 3 B, 3 C; 248/575, 635, 634; 403/168

[56] References Cited

U.S. PATENT DOCUMENTS

| | | | |
|---|---|---|---|
| 2,103,480 | 12/1937 | Mason | 187/95 X |
| 2,490,652 | 12/1949 | Sahlin | 308/3 B |
| 3,554,327 | 1/1971 | Takamura et al. | 187/95 |
| 4,271,932 | 6/1981 | Klein | 187/95 |

*Primary Examiner*—Joseph J. Rolla
*Assistant Examiner*—Nils E. Pedersen

[57] ABSTRACT

A sliding guide that follows the rail in an elevator consists of a guide shoe made of low friction, durable material which is mounted in a shoe retainer. The shoe retainer, in turn, is mounted in an elastomeric pad which is mounted in a bracket that is connectable to the elevator car. The rigidity of the elastomeric pad is adjustable in discrete steps by adding rigid material to the pad. The retainer is adapted to connect with more than one pad. The retainer may, therefore, be attached to two pads, and the rigidity of both of these pads is adjustable.

1 Claim, 4 Drawing Figures

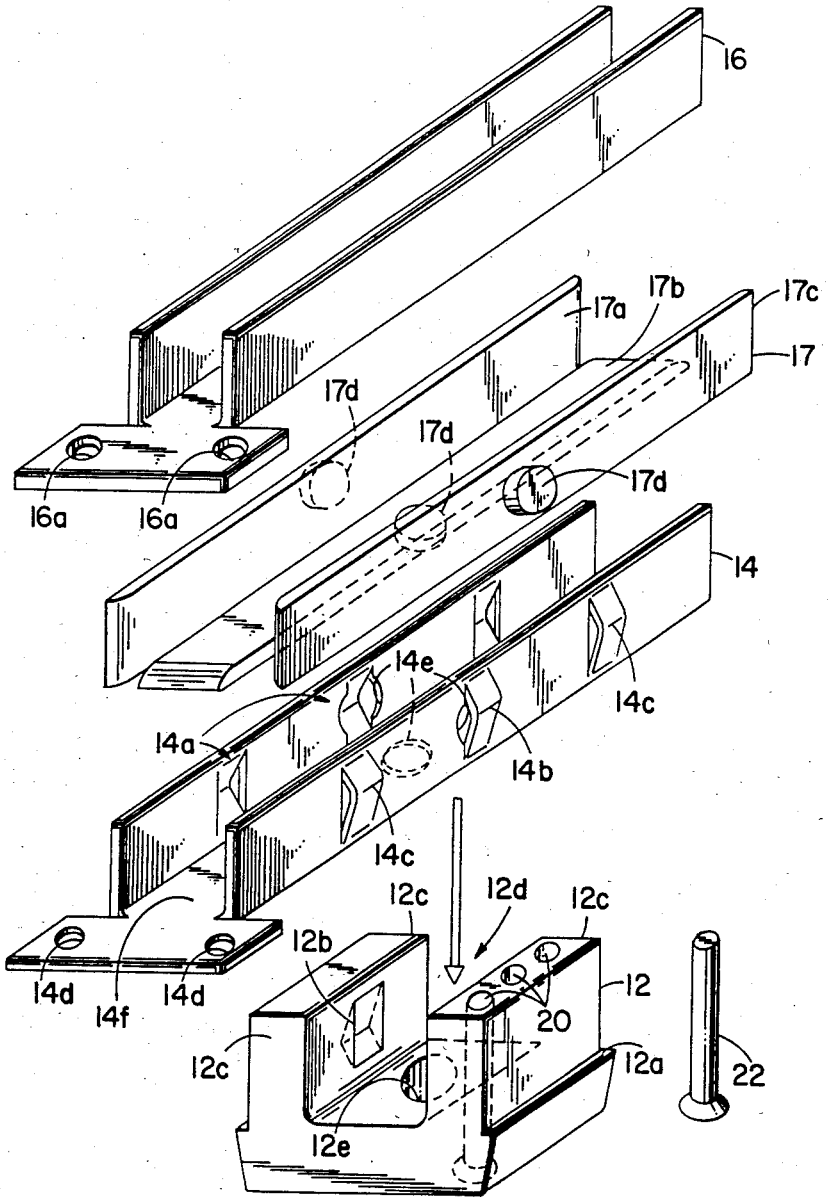
FIG. 1
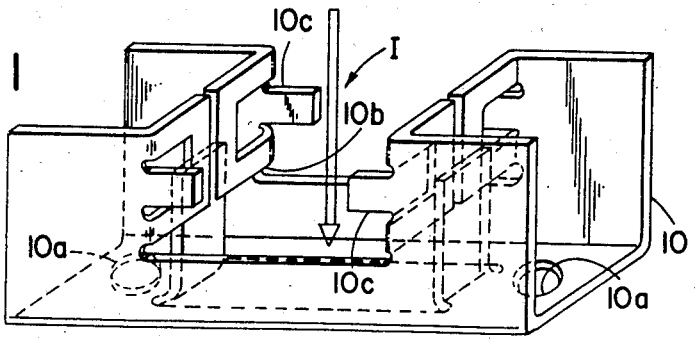

SLIDING SHOE SYSTEM

TECHNICAL FIELD

This invention relates to elevators, and, in particular, to elevator guide devices used in many elevators for connecting the elevator car and the elevator guide rail that extends through the hoistway.

BACKGROUND ART

Some elevators use a guide roller arrangement to guide the car on the guide rail, while others use a guide which typically contains a sliding shoe—low friction shoe that slides on the rail. In many of these guides, an elastomeric pad (mount) interconnects a guide shoe retainer—a bracket that is attached to the car. The mount, typically a pad of rubber, absorbs noise and vibration. Its characteristics must be closely matched to the total mass of the car, which includes the frame and the cab. If the elastomer is too stiff, there is inadequate shock and noise absorption, the ride is hard. If it is too soft, the ride is uneven.

DISCLOSURE OF INVENTION

According to one aspect of the invention, an elevator guide contains an elastomeric pad, e.g., hard rubber, whose rigidity is mechanically adjustable in discrete steps by adding rigid material to the pad.

According to another aspect of the invention, this pad contains one or more holes, and a rigid pin is inserted into the hole.

According to another aspect of the invention, an elevator guide contains a guide shoe and a shoe retainer, which is adapted to be connected to one or more identical elastomeric pads, each of which is attached to its own bracket that is connectable to the elevator car. The retainer contains alignment and locking portions that connect with each pad. The same retainer may be used with one or two pads, depending upon the requirements dictated by the mass of the car.

BRIEF DESCRIPTION OF THE DRAWING

FIG. 1 is an exploded isometric view of a guide embodying the present invention.

BEST MODE FOR CARRYING OUT THE INVENTION

Figure 3:
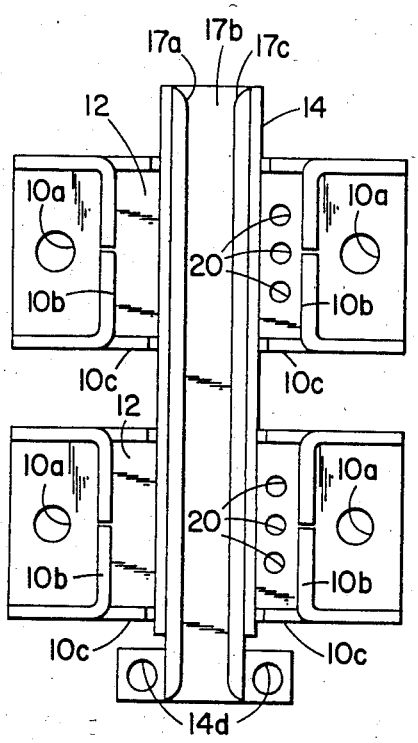
FIG. 3 is an elevational view of a second version of a guide embodying the present invention.

Referring to FIG. 1, it shows, in exploded form, the components of an elevator guide embodying the present invention. This guide includes a bracket 10. The bracket is bolted, by means of the holes 10*a*, to the car frame and it receives an "adjustable" elastomeric pad (hard rubber) 12. The pad is held in place in the bracket when its edges 12*a* fit just beneath the edges 10*b* in the bracket. Similarly, the pad is held longitudinally (axis I) by four tabs 10*c* that extend roughly perpendicularly to that longitudinal axis.

A guide retainer 14 fits into the elastomer 12. It contains locking protrusions or elevations 14*a* that extend outwardly. This shoe 14 has generally a C-shaped or channel-shaped configuration that is defined by two vertically upstanding side pieces. The tabs 14*a* extend outwardly from these side pieces. There are three tabs 14*a* on each side. The middle tab 14*b* fits into a slot 12*b* in the pad, while the tabs 14*c* on each side of this middle tab 14*b* grab (register) with the outer edges 12*c* on the pad. In this way, the member 14 is rigidly held in place in the center (channel portion) 12*d* of the pad.

Figure 4:
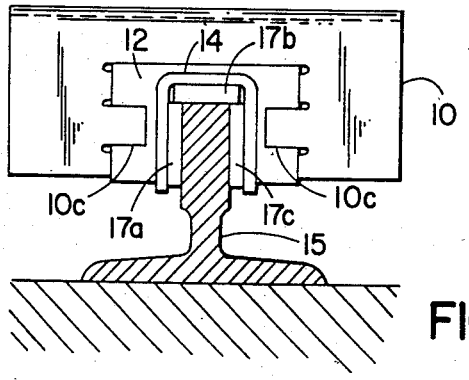
FIG. 4 is a plan view showing an elevator guide according to the present invention on a typical elevator guide rail.

The retainer 14 receives a shoe that contacts the rail 18 (see FIG. 4). One of two possible types of elevator shoes 16,17 are shown. Either one is intended to make contact with the elevator guide, and thus they should be made of suitable smooth, durable, nonbinding material. Brass is a good choice. The first of these shoes, 16, is held in place in the shoe retainer 14 by bolting it in place. For that purpose, the retainer 14 contains holes 14*d*; these register with the holes 16*a* on the shoe. The shoe (one piece) is U-shaped to receive the rail 18 (see FIG. 4).

The other shoe arrangement 17 is shown in FIG. 1. This consists of three separate "contact" pieces 17*a*, 17*b* and 17*c*. They fit within the central portion of the retainer 14. To receive this particular shoe (the pieces 17*a*, 17*b*, 17*c*) the retainer contains three holes 14*e*. One of these holes is located on the base or flat portion 14*f*; the other two holes are located opposite each other, comprising part of the cutout portion for opposite tabs 14*b*. Each hole receives a locking tab (post) 17*d* that is on each of the shoe's elements 17*a*, 17*b* and 17*c*. The tabs hold the shoe in place within the retainer 14, and this is shown in FIG. 4, which also shows a typical guide rail 15, the three shoe pieces 17*a*, 17*b* and 17*c* around it, and the pad 12 which is fastened to the bracket 10. (The elevator car to which the bracket is fastened is not shown. This is well known.)

The pad contains a plurality of holes 20, as FIG. 1 shows. In this version, there are three holes. Each of these holes may receive a rigid pin 22. (See the dotted line drawing of the pin in FIG. 1.) The pin may be made of steel or brass, even plastic or wood. It should be rigid in the sense that it is stiffer than the pad material. The pad 12 also contains a hole 12*e*; this hole accommodates the portion of the tab 17*d* that extends through the shoe retainer hole 14*e* from the shoe element or piece 17*b*.

In the version shown in FIG. 1, the elastomer has four distinct elastomeric (stiffness) characteristics (softness levels). The guide arrangement comprising the bracket, the pad, the retainer, and the shoe therefore can be matched, in four possible ways, to the mass of the elevator car. This is done simply by inserting one, two, or three pins, or leaving out the pins entirely. As each pin is inserted, the pad's rigidity is increased, increasing the stiffness of the resultant guide.

Figure 2:
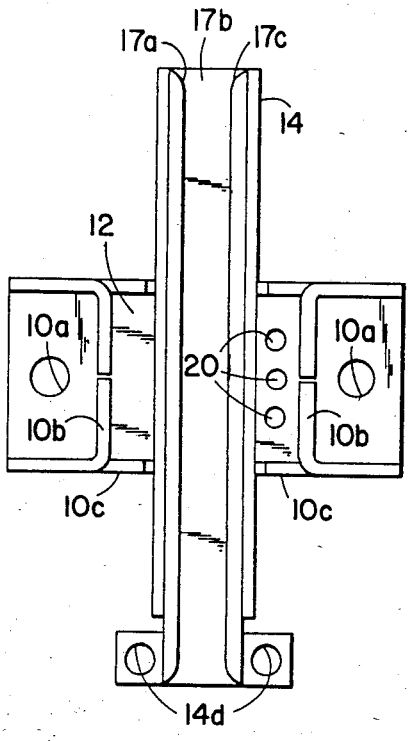
FIG. 2 is an elevational view of one version of a guide embodying the present invention.

FIG. 2 shows the guide illustrated in FIG. 1, that is, a single bracket, a single pad, and a single shoe and retainer. In contrast, FIG. 3 shows a different version: this one has two brackets, two elastomers, but one retainer and one shoe, and they are inserted into both pads. In FIG. 2, there are four possible elastomeric characteristics, because there can be either one, two, three, or no pins inserted. On the other hand, in FIG. 3 there are more possible changes in elastomeric characteristics, eight, to be exact. FIG. 3 is desirable for a particularly heavy cab. It usually calls for more stiffness. The same pads may be used in FIG. 3 to accommodate the higher mass of a heavier cab. That is why two pads are used (rather than one) with two brackets. One should observe that the single retainer is held in each pad the same way as in the single pad arrangement. That is, the tabs 14*a* are spaced apart so that more than one pad can be locked to the retainer. The pads are attached side-by-side on the retainer; each is placed in its own bracket.

The foregoing demonstrates the "universality" of the guide arrangement according to the present invention. The same bracket elastomer shoe and retainer elements or members may be used in a wide variety of different applications, thus eliminating the requirement for different guide parts. This reduces manufacturing expenses. It also makes it much easier to repair defective components in existing equipment. A service technician, for example, may carry, as an inventory item, a standard pad and several pins. He may custom-fit, so to speak, the elastomer to the required installation when replacing a worn-out elastomer. The other parts are also standard items he can carry. Since all the other components are the same, the inventory of parts he is required to carry for routine service is significantly reduced. The invention, it is plain to see, provides a "modular elevator guide".

To one skilled in the art, the foregoing description of one or more preferred embodiments of the present invention will suggest modifications and variations, without departing from the true scope and spirit of the invention that has been described.

I claim:

1. An elevator guide, comprising:

a guide shoe;

a guide bracket for attaching the guide to an elevator car;

a shoe retainer;

an elastomeric pad;

the retainer being mounted on the pad, the pad being mounted on the bracket;

characterized by:

the rigidity of the pad being mechanically adjustable in discrete steps by adding rigid material to the pad;

the pad containing at least one hole for receiving a rigid pin;

a second bracket;

a second one of said pads mounted in the bracket;

the retainer being mounted in each pad; and the retainer containing longitudinal allignment and locking elements for attaching the retainer to at least two of said pads substantially side-by-side.

* * * * *